US007543562B2

(12) United States Patent
Grossmann et al.

(10) Patent No.: US 7,543,562 B2
(45) Date of Patent: Jun. 9, 2009

(54) METHOD AND DEVICE FOR OPERATING AN INTERNAL COMBUSTION ENGINE

(75) Inventors: Alex Grossmann, Leonberg (DE); Michael Drung, Muehlacker (DE); Torsten Baumann, Eppingen-Adelshofen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/590,941

(22) Filed: Oct. 31, 2006

(65) Prior Publication Data

US 2007/0107694 A1 May 17, 2007

(30) Foreign Application Priority Data

Oct. 31, 2005 (DE) ..... 10 2005 052 033

(51) Int. Cl.
*F02D 9/08* (2006.01)
*F02D 9/10* (2006.01)

(52) U.S. Cl. ..... 123/337; 123/399

(58) Field of Classification Search ..... 123/337, 123/376, 395, 396, 397, 398, 399, 400, 403, 123/404; 73/118.1, 116

See application file for complete search history.

(56) References Cited

U.S. PATENT DOCUMENTS

| | | | | |
|---|---|---|---|---|
| 4,436,069 | A * | 3/1984 | Collonia | 123/339.25 |
| 5,213,078 | A * | 5/1993 | Kolberg et al. | 123/399 |
| 5,315,975 | A * | 5/1994 | Hattori et al. | 123/337 |
| 5,746,176 | A * | 5/1998 | Damson et al. | 123/336 |
| 5,787,861 | A * | 8/1998 | Suzuki et al. | 123/396 |
| 6,769,395 | B2 * | 8/2004 | Jaksch et al. | 123/336 |
| 6,895,929 | B2 * | 5/2005 | Grossmann et al. | 123/399 |
| 7,194,319 | B2 * | 3/2007 | Grossmann et al. | 700/33 |
| 2001/0039940 | A1 * | 11/2001 | Kuretake | 123/399 |
| 2002/0169573 | A1 * | 11/2002 | Reuschenbach et al. | 702/100 |

* cited by examiner

*Primary Examiner*—Mahmoud Gimie
(74) *Attorney, Agent, or Firm*—Kenyon & Kenyon LLP

(57) ABSTRACT

A method and a device are provided for operating an internal combustion engine, which make possible an improved characteristics curve correction of an actuator in an air supply of the internal combustion engine. In the process, an air mass flow supplied to the internal combustion engine is influenced via the actuator in an air supply. For the setting of an actuating position of the actuator having a specified, e.g., minimum, air mass flow, starting from a specified actuating position, the actuator is moved by an offset value of the actuating position. The offset value of the actuating position is corrected as a function of an offset value for the air mass flow.

10 Claims, 5 Drawing Sheets

ṁ

Δ NLP
Δ DTP
40
ṁoffsetn
0
α DK
NLP
DTP
α DKoffsetn

METHOD AND DEVICE FOR OPERATING AN INTERNAL COMBUSTION ENGINE

CROSS-REFERENCE TO RELATED APPLICATIONS

The present application claims priority to Application No. 10 2005 052 033.2, filed in the Federal Republic of Germany on Oct. 31, 2005, which is expressly incorporated herein in its entirety by reference thereto.

FIELD OF THE INVENTION

The present invention relates to a method and a device for operating an internal combustion engine.

BACKGROUND INFORMATION

In this context, it is conventional that the air mass flow supplied to the internal combustion engine is influenced via an actuator in an air supply. Such an actuator, in this context is conventional in the form of a throttle valve. In order to set an actuating position of the throttle valve that results in a minimum air mass flow, the throttle valve is moved by an offset value of the actuating position, starting from a mechanical stop which corresponds, for example, to an emergency air position.

A throttle valve operated in this manner is also referred to as dip-through throttle construction. Faults, that come about because of tolerance-encumbered mounting of the throttle valve and because of tolerances of one or more sensors for the recording of the actuating position of the throttle valve, lead to a malposition of the throttle valve. In order to keep this malposition and the reactions of the internal combustion engine connected with it as low as possible, a tight tolerance must be demanded in the manufacturing and installation of the throttle valve as well as in the sensor(s).

SUMMARY

A method according to example embodiments of the present invention and a device according to example embodiments of the present invention for operating an internal combustion engine may provide that the offset value of the actuating position is corrected as a function of an offset value for the air mass flow. In this manner, using the offset value for the air mass flow, one may succeed in detecting and correcting a malposition of the actuator due to manufacturing and installation. Consequently, a widening of the tolerance band during manufacturing and installation of the actuator is made possible and also of the sensors for detecting the actuating position of the actuator. Furthermore, tolerances conditioned upon aging or wear of the actuator or the sensor(s) named, also do not lead to undesired reactions of the internal combustion engine, but are able to be compensated for by the correction of the offset value.

The offset value of the actuating position may be corrected as a function of whether the offset value for the air mass flow falls below a specified minimum value or exceeds a specified maximum value. In this manner, the admissible tolerance for the setting of a desired actuating position of the actuator is no longer conditioned upon manufacturing and installation of the actuator or the sensor(s) named, but upon the range between the specified minimum value and the specified maximum value for the air mass flow. The admissible tolerance range may thus be specified at will, and is no longer conditioned upon manufacturing or installation.

The specified minimum value or the specified maximum value may be ascertained as a function of a difference, e.g., maximum in absolute quantity, between a nominal characteristics curve of the actuator and a boundary characteristics curve of the actuator. In this manner, the desired tolerance range is specified particularly simply with the aid of one or two boundary characteristics curves of the actuator.

In this instance, a characteristics curve of the actuator is suitable as boundary characteristics curve which is selected so that it is shifted by a maximum tolerance angle with respect to the nominal characteristics curve. The maximum tolerance angle may be specified in a desired manner, in this process, and may particularly be smaller than a tolerance angle conditioned upon manufacturing and installation of the actuator as well as the sensor(s) named. Consequently, a smaller tolerance range may be specified than that conditioned upon manufacturing and installation.

One particularly simple implementation of the correction of the offset value of the actuating position, as a function of the offset value for the air mass flow, is obtained if the offset value of the actuating position is increased when the offset value for the air mass flow falls below a specified minimum value or when the offset value of the actuating position is lowered when the offset value for the air mass flow exceeds the specified maximum value.

It may be provided that the offset value for the air mass flow is adjusted as a function of the deviation of a first value for the air mass flow, recorded by first sensor device(s), from a second value for the air mass flow, recorded by second sensor device(s), at the same actuating position of the actuator. In this manner, a malposition of the actuator within the admissible tolerance range may be corrected by adjustment of the offset value for the air mass flow.

In this context, it may be provided in a simple manner to select the first sensor device as a main load sensor or a main charge sensor, e.g., as pressure sensor in the air supply, and the second sensor device as a secondary load sensor or a secondary charge sensor, e.g., as sensor for recording the actuating position of the actuator. In this manner, the described adjustment of the offset value for the air mass flow may be implemented with the aid of a sensor system that is already present, and thus without additional expenditure.

Example embodiments of the present invention are described in more detail below with reference to the appended Figures.

DETAILED DESCRIPTION

Figure 1:
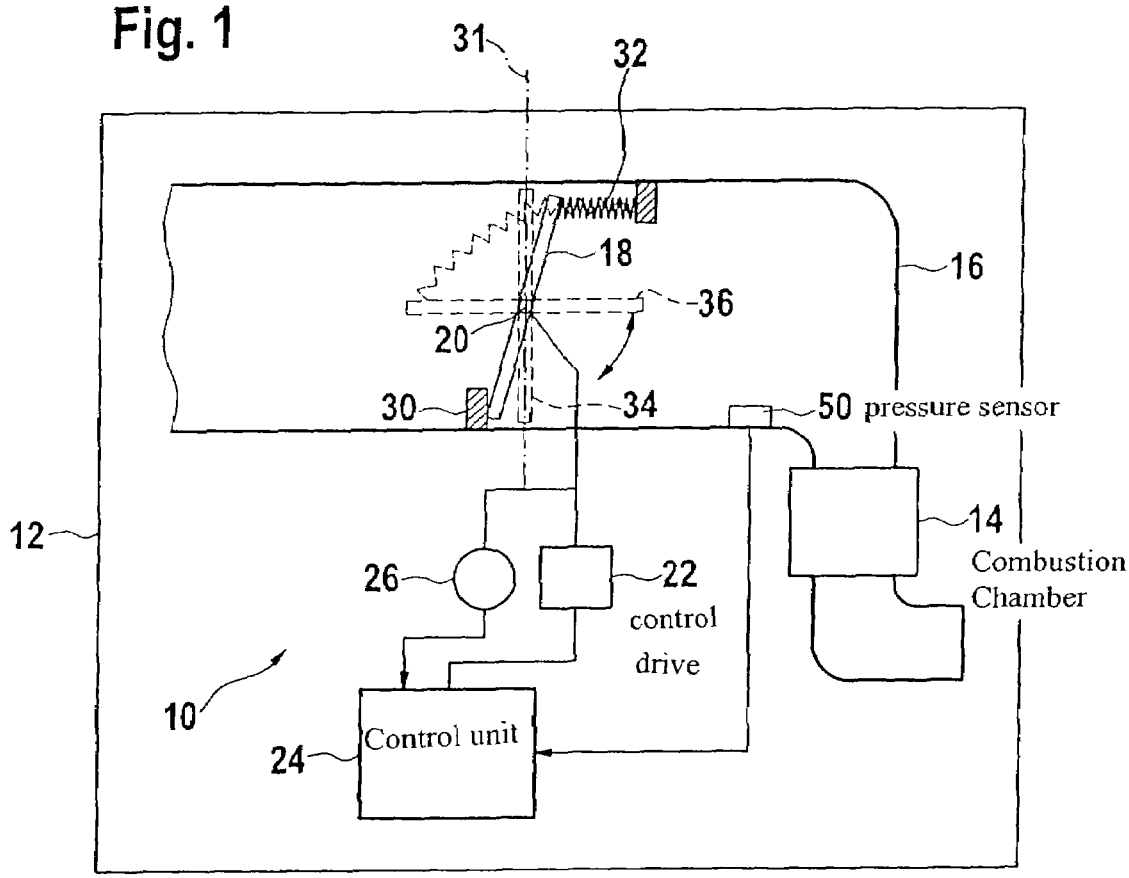
FIG. 1 is a block diagram of an internal combustion engine driving a vehicle having a dip-through throttle valve in the air supply, as well as its control.

In FIG. 1, an internal combustion engine as a whole bears reference numeral 10. It is used, for example, for driving a motor vehicle which is indicated only schematically as a rectangle and bears reference numeral 12. Internal combustion engine 10 includes at least one combustion chamber 14, into which the combustion air gets via air supply 16, for instance, in the form of an intake pipe. In this pipe there is situated an actuator 18, for instance, in the form of a throttle valve. Because of the latter, the flow cross section of intake pipe 16 can be changed in the region of throttle valve 18, and with that, the air mass flow supplied to internal combustion engine 10, or rather combustion chamber 14 is able to be influenced.

Throttle valve 18 is able to be rotated about a rotary axis 20 that is perpendicular to the plane of the paper sheet. To do this, throttle valve 18 is coupled to an actuating drive 22, which is activated by a control unit and/or regulating unit 24. The current angle setting or actuating position of throttle valve 18 is recorded by a sensor 26, for instance, in the form of a slider potentiometer, e.g., in a conventional manner, which supplies its measuring signals to control unit and/or regulating unit 24. The positioning of throttle valve 18 takes place, in the normal case, as in a closed control loop, the system deviation being formed by comparison of the signals of slider potentiometer 26 to a setpoint value for the actuating position of throttle valve 18. In FIG. 1, throttle valve 18 is shown in an angular setting in which it lies against a lower stop 30, and is rotated a little beyond a plane 31 that is perpendicular to the longitudinal axis of intake pipe 16. This position is also designated as an "emergency air position," since, at this point, the flow cross section is slightly larger than the minimum one, in order to make possible an emergency operation of internal combustion engine 10 in case of a failure of control unit or regulating unit 24 and/or control drive 22. In this air emergency position, throttle valve 18 is shown, for example, as in FIG. 1, having a tension spring 32 applied to it which is under tension between throttle valve 18 and intake pipe 16.

That setting of throttle valve 18, at which the flow cross section is a minimum, is shown in FIG. 1 by dashed lines and is designated by reference numeral 34. This setting is referred to as the "dip-through position." That position of throttle valve 18, in which the flow cross section in the region of throttle valve 18 is a maximum, is also shown by dashed lines, and is characterized by reference numeral 36. In this position, throttle valve 18 lies parallel to the longitudinal axis of intake pipe 16.

Downstream of throttle valve 18 and upstream from the at least one combustion chamber 14, a pressure sensor 50 is built into intake pipe 16, and it continuously measures the pressure at this location in intake pipe 16, and also passes the measuring result on to control unit and/or regulating unit 24.

In this context, pressure sensor 50 represents a main load sensor and slider potentiometer 26 represents a secondary load sensor. The main load sensor, in this instance, may also be designated as main charge sensor, and the secondary load sensor may be designated as secondary charge sensor. Slider potentiometer 26 for ascertaining the actuating position of throttle valve 18 may also be designated as throttle valve sensor.

Figure 2:
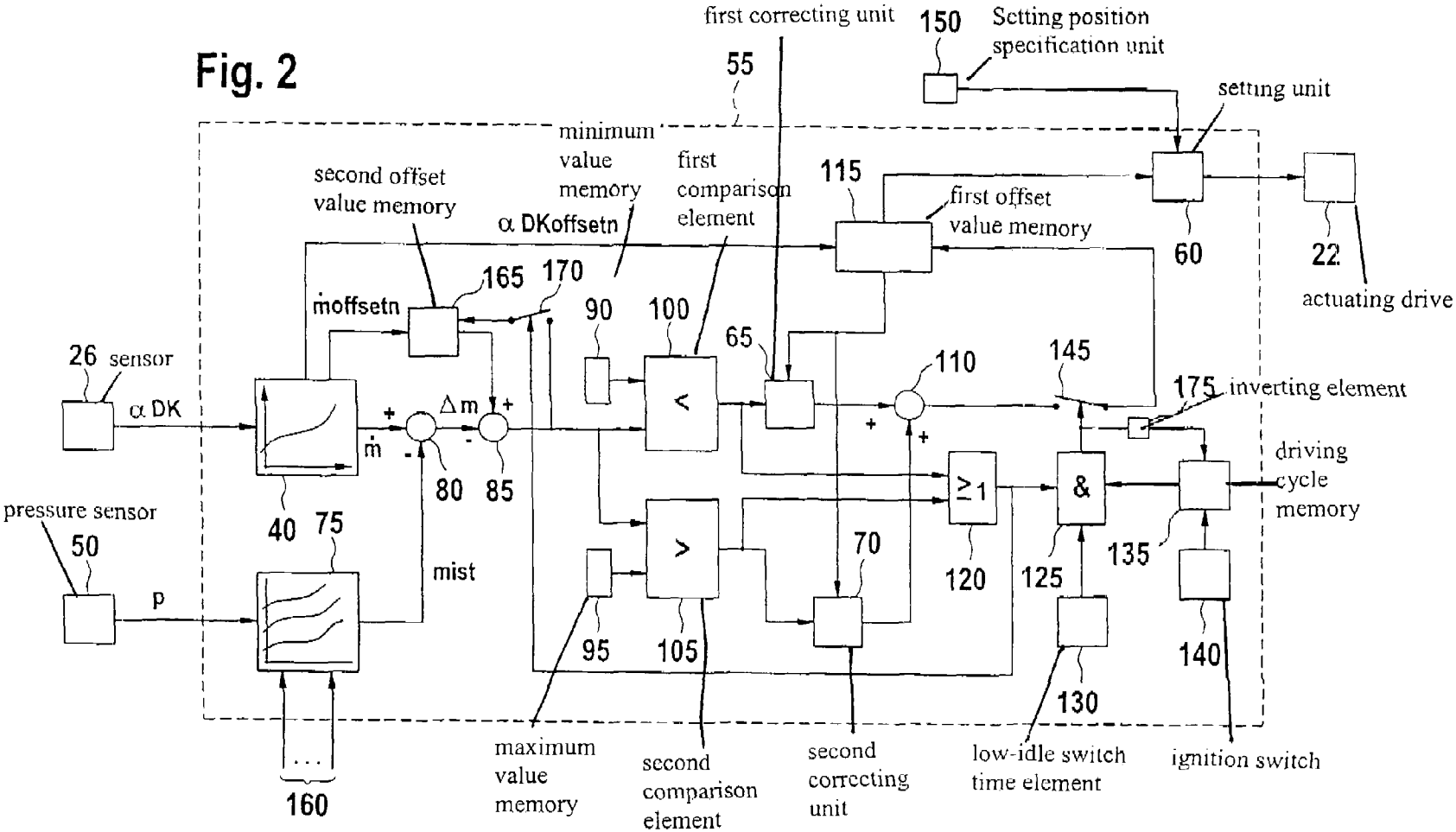
FIG. 2 is a functional diagram for explaining a device and a method hereof.

FIG. 2 shows a functional diagram of a device 55, in light of which the operating manner of the method will be described below. Device 55 is able to be implemented, in this instance, software and/or hardware-wise in control unit and/or regulating unit 24.

Figure 4:
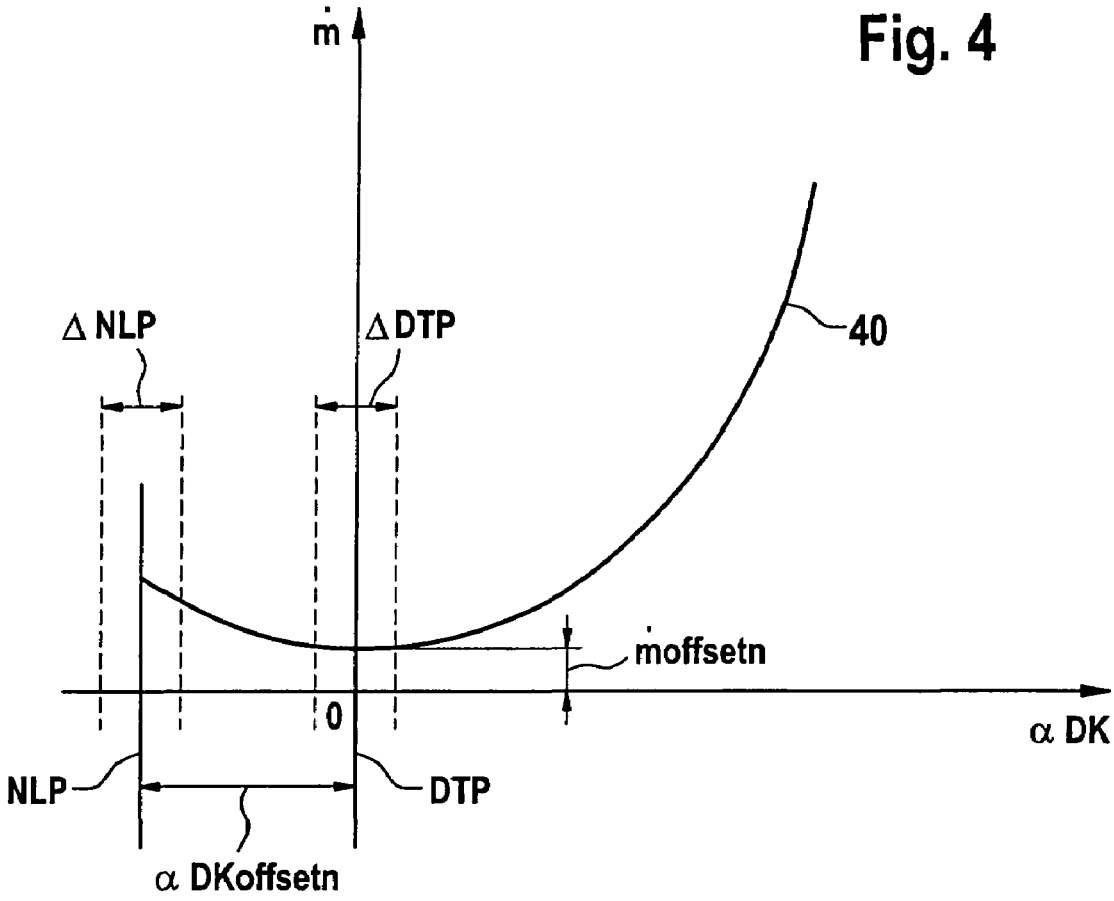
FIG. 4 is a nominal characteristics curve of a dip-through throttle valve.

A voltage is supplied by slider potentiometer 26 to a nominal characteristics curve 40 of device 55 as an input variable, which corresponds to an actuating position αDK of throttle valve 18. Nominal characteristics curve 40 may be specified, for instance, by the manufacturer of throttle valve 18 for a series of identical throttle valves. FIG. 4 shows an example of such a characteristics curve 40 in the form of a diagram of air mass flow m supplied to the at least one combustion chamber as a function of throttle valve angle αDK. Throttle valve angle αDK equal to zero corresponds to dip-through position DTP. At lower mechanical stop 30 of throttle valve 18, emergency air position NLP is located in the negative throttle valve angle area. From emergency air position NLP to dip-through position DTP, air mass flow m drops off and, at dip-through position DTP it reaches a minimum, so as subsequently, in the positive throttle valve angle area, to rise strictly monotonically up to a maximum air mass flow, which is reached at position 36. The angular distance between emergency air position NLP and dip-through position DTP represents an offset value of the actuating position for nominal characteristics curve 40, and is designated by αDKoffsetn. The minimum of air mass flow m for throttle valve angle αDK equal to zero represents an offset value for the air mass flow of nominal characteristics curve 40, and is designated in FIG. 4 by m offsetn. Because of manufacturing tolerances during the production of individual throttle valves using characteristics curve 40 as well as the assembly of such a throttle valve in intake pipe 16, tolerances come about which lead to bringing about an actual characteristics curve, deviating from nominal characteristics curve 40, which is shifted compared to nominal characteristics curve 40 by a certain throttle valve angle. This shifting results, for instance, from a manufacturing tolerance of lower mechanical stop 30 or emergency air position NLP, and is shown in FIG. 4 by tolerance range ΔNLP. From emergency air position NLP one reaches dip-through position DTP, taking into consideration specified offset value αDKoffsetn of the actuating position. Consequently, based on tolerance range ΔNLP for the emergency air position, a corresponding tolerance range ΔDTP comes about for the dip-through position, as is drawn in in FIG. 4. Specified offset value αDKoffsetn of the actuating position is ascertained from nominal characteristics curve 40, and is used for the initialization of a first offset value memory 115 of device 55. This means that, during the initial operation of internal combustion engine 10, first offset value memory 115 is described by offset value αDKoffsetn that is read out from nominal characteristics curve 40.

Tolerance range ΔNLP, and therewith also tolerance range ΔDTP, may also increase with time, based on aging, wear and soiling of lower mechanical stop 30.

Figure 5:
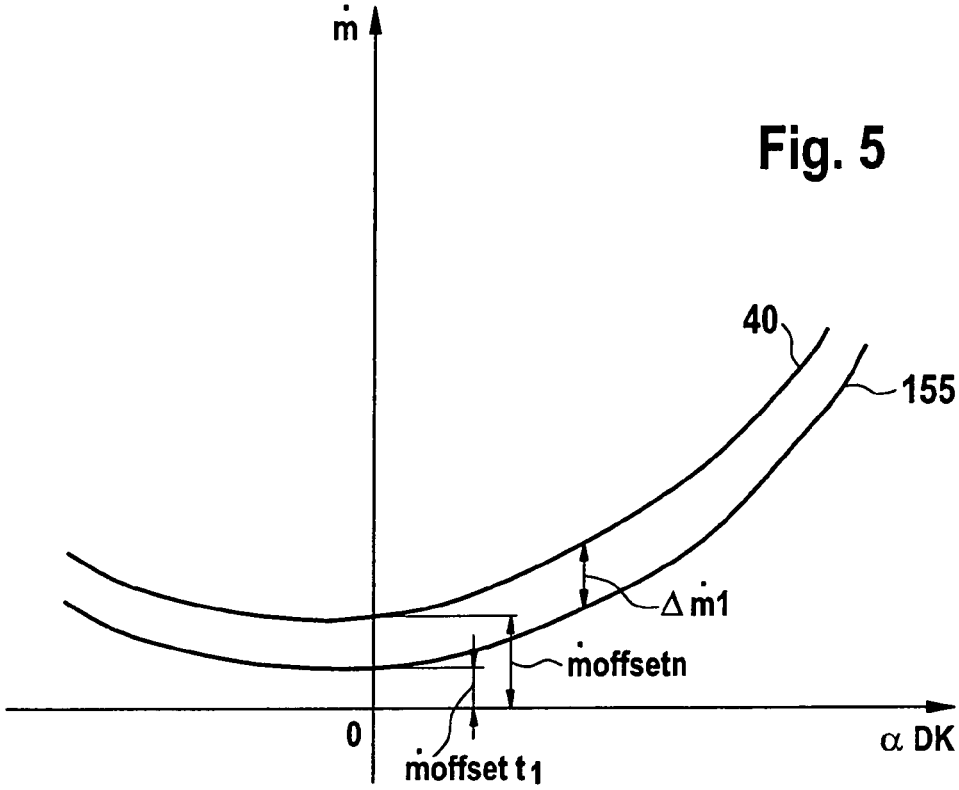
FIG. 5 is a nominal characteristics curve and an actual characteristics curve of the throttle valve at the same offset value of the actuating position.

Besides the tolerance, described in FIG. 4, of the actual characteristics curve compared to nominal characteristics curve 40 with regard to throttle valve angle αDK, it is also possible to have a tolerance of the actual characteristics curve compared to nominal characteristics curve 40 with regard to air mass flow m, as is shown in FIG. 5. In FIG. 5, as in FIG. 4, nominal characteristics curve 40 has offset value m offsetn for air mass flow m, whereas the actual characteristics curve, which is characterized in FIG. 5 by reference numeral 155, has an actual offset value m offsett1 for the air mass flow. First actual offset value m offsett1 for the air mass flow is, in this instance, smaller for each throttle valve angle αDK by a first difference value Δm1 than offset value m offsetn for the air mass flow of nominal characteristics curve 40. Consequently, actual characteristics curve 155 is shifted downwards by the first difference value Δm1 compared to nominal characteristics curve 40 for each throttle valve angle αDK, that is, to smaller air mass flow values. Nominal characteristics curve 40 and actual characteristics curve 155 have the same offset value αDKoffsetn of the actuating position, in this case. Offset value m offsetn for the air mass flow is ascertained from nominal characteristics curve 40, and is used for the initialization of a second offset value memory 165 of device 55. This means that, during the initial operation of internal combustion engine 10, second offset value memory 165 is described by offset value m offsetn that is read out from nominal characteristics curve 40.

The characteristics curve tolerance with regard to air mass flow m is conditioned, for instance, by manufacturing tolerances of the individual throttle valves having the same nominal characteristics curve 40, and may become greater in the course of time by aging, wear and soiling of throttle valve 18.

Figure 6:
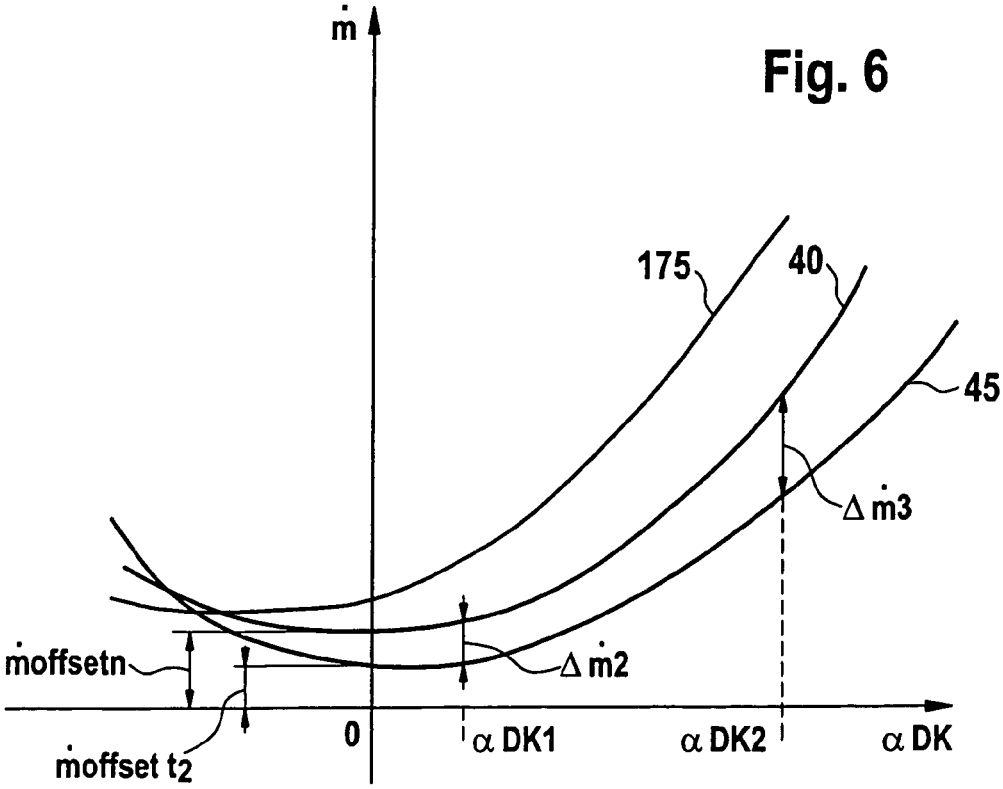
FIG. 6 is a nominal characteristics curve and an actual characteristics curve of the throttle valve at a different offset value of the actuating position.

The two examples according to FIGS. 4 and 5 reveal that, quite generally, and as shown in FIG. 6, the actual characteristics curve is able to be tolerance-encumbered and thus shifted from nominal characteristics curve 40, both with respect to throttle valve angle αDK and with respect to air mass flow m. FIG. 6 shows second actual characteristics curve 45. This is, for one thing, tolerance-encumbered with respect to air mass flow m, as described by FIG. 5. This shows, in that second actual characteristics curve 45 according to FIG. 6 has a second actual offset value m offset2, which is smaller than offset value m offsetn for the air mass flow of nominal characteristics curve 40.

Furthermore, second actual characteristics curve 45 has a greater offset value of the actuating position, and is thus shifted with respect to nominal characteristics curve 40 to smaller throttle valve angles αDK. This shifting is also noticeable in the different offset values for the air mass flow of nominal characteristics curve 40 and of second actual characteristics curve 45. Incidentally, the shifting of second actual characteristics curve 45 compared to nominal characteristics curve 40 with regard to throttle valve angle αDK also leads to different difference values for air mass flow m coming about for different throttle valve angles αDK. Thus, for a first positive throttle valve angle αDK1, there comes about a second difference value Δm 2 for the air mass flow between nominal characteristics curve 40 and second actual characteristics curve 45. For a second throttle valve angle αDK2, which is larger than first throttle valve angle αDK1, there comes about between nominal characteristics curve 40 and second actual characteristics curve 45 a third difference value Δm 3 with respect to air mass flow m, which is greater than second difference value Δm 2.

The output variable of nominal characteristics curve 40 in device 55 is air mass flow m of nominal characteristics curve 40 that is assigned to throttle valve angle αDK supplied as input value to nominal characteristics curve 40, and it is supplied to a first subtraction element 80. Device 55 also has a characteristics map 75, to which the pressure ascertained by pressure sensor 50 downstream of throttle valve 18 in intake pipe 16 is supplied as input variable, and which is also designated as intake pipe pressure. Furthermore, one or several additional operating variables 160 of internal combustion engine 10 are supplied to characteristics map 75 as input variables. Characteristics map 75 may, for example, are applied on a test stand, e.g., in a conventional manner, and it supplies as output variable an actual value m ist for the air mass flow, which is supplied to the at least one combustion chamber 14 via intake pipe 16. This actual value m ist for the air mass flow is subtracted in first subtraction element 80 from air mass flow m of nominal characteristics curve 40. Consequently, there is obtained at the output of first subtraction element 80 a difference value Δm between air mass flow m of nominal characteristics curve 40 and the actual air mass flow m ist, for measured actuating position αDK of the throttle valve, to which, of course, measured intake pipe pressure p and the at least one additional operating variable 160 of internal combustion engine 10 are also assigned. Thus, Δm=m−m ist. Difference value Δm is subtracted in a second subtraction element 85 from the offset value, stored in second offset value memory 165, for the air mass flow, in order to obtain, at the output of second subtraction element 85, a corrected offset value for the air mass flow. This is compared in a first comparison element 100 to a specified minimum value read out from a minimum value memory 90. In addition, the corrected offset value for the air mass flow is compared in a second comparison element 105 to a specified maximum value read out from a maximum value memory 95. If the corrected offset value for the air mass flow falls below the specified minimum value, the output of first comparison element 100 is set; otherwise it is reset. If the corrected offset value for the air mass flow exceeds the specified maximum value, the output of first comparison element 105 is set; otherwise it is reset. The output of first comparison element 100, in this context, is conveyed to a first correction unit 65, and the output of second comparison element 105 is conveyed to a second correction unit 70. In addition, from first offset value memory 115, the offset value stored there of the actuating position is conveyed to first correction unit 65 and to second correction unit 70. A computing program is implemented in first correction unit 65 which, in case the output of first comparison element 100 is reset, outputs the value zero at its output. If, however, the output of comparison element 100 is set, first correction unit 65 increments the offset value of the actuating position supplied by first offset memory 115 by a specified incrementing value, and outputs this at its output. The output at the output of first correction unit 65 is supplied to an addition element 110. In a corresponding way, in second correction unit 70 a computing program is implemented which sets the output of second correction unit 70 to zero if the output of second comparison element 105 is reset. If, on the other hand, the output of second comparison element 105 is set, then, in second correction unit 70 the offset value of the actuating position read out from first offset value memory 115 is decremented by a second specified incrementing value, and the offset value of the actuating position thus corrected is made available at the output of second correction unit 70. The output of second correction unit 70 is also supplied to addition element 110, in this instance. The first specified incrementing value used in first correction unit 65, and the second specified incrementing value used in second correction unit 70 may be suitably applied selected of the same size, but may generally also be suitably applied selected of different sizes, for instance on a test stand.

Nominal characteristics curve 40 initially, that is when internal combustion engine 10 is first put into operation, supplies its offset value αDKoffsetn of the actuating position to first offset value memory 115 for the offset value of the actuating position, and stores it there. Moreover, characteristics curve 40 initially, that is when internal combustion engine 10 is first put into operation, supplies offset value m offsetn for the air mass flow to second offset value memory 165 for the offset value for the air mass flow, and stores it there.

The output of first comparison element 100 and the output of second comparison element 105 are also supplied as input variables to an OR-gate 120, whose output is set if at least one of the outputs of first comparison element 100 and of second comparison element 105 is set and otherwise is reset. The output of OR-gate 120 is supplied to an AND-gate 125 as input variable, and to this AND-gate 125 there are also supplied the output variable of a low-idle switch time element 130 and the output variable of a driving cycle memory 135 as input variables. The output of low-idle switch time element 130 is set if, since the operation of a low-idle switch and thus since the setting in of a low-idle operating state of internal combustion engine 10, a specified time has elapsed which, for instance, may have been suitably applied on a test stand. Driving cycle memory 135 is set using the operation of an ignition switch 140, and outputs a corresponding set bit to AND-gate 125. The output of AND-gate 125 is fed back to driving cycle memory 135 via an inverting element 175. Thus, if the output of AND-gate 125 is set, driving cycle memory 135 is permanently reset up until the next driving cycle, which is initiated by renewed operation of the ignition switch. The use of low-idle switch time element 130 and of driving cycle memory 135 is optional in each case, and not absolutely required for the implementation hereof. However, it does make possible a more stable correction of the offset value of the actuating position, and it avoids a too frequent updating of this offset value, which could lead to an undesired oscillation during the control of throttle valve 18.

If neither low-idle switch time element 130 nor driving cycle memory 135 is provided, AND-gate 125 may also be omitted, and the output of OR-gate 120 may be used directly for controlling a first controlled switch 145. In the exemplary embodiment illustrated in FIG. 2, the output of AND-gate 125 is, however, used for controlling first controlled switch 145. If the output signal of AND-gate 125 is set, first controlled switch 145 is closed to connect the output of addition element 110 to first offset value memory 115. Consequently, first offset value memory 115 is overwritten with the output of addition element 110 as the new offset value of the actuating position. This new offset value thus comes about as the sum of the output of first correction unit 65 and the output of second correction unit 70. If the output of AND-gate 125 is reset, first controlled switch 145 is opened, and overwriting of first offset value memory 115 does not take place. If AND-gate 125 is not provided, the output of OR-gate 120 controls first controlled switch 145 in a corresponding way. The output of OR-gate 120 is also supplied to a second controlled switch 170, which is used for connecting the output of second subtraction element 85 to second offset value memory 165. If the output of OR-gate 120 is reset, second controlled switch 170 is closed and second offset value memory 165 is overwritten using the output of second subtraction element 85 as the new offset value for the air mass flow. If the output of OR-gate 120 is set, second controlled switch 170 remains open, and no overwriting of second offset value memory 165 takes place.

The output of first offset value memory 115 is supplied to a setting unit 60, to which is also supplied the signal of a setting position specification unit 150. Setting position specification unit 150 will specify, for example, a throttle valve angle αDK greater than zero, as a function of an accelerator setting. Setting unit 60 then adds to this specified positive throttle valve angle the offset value of the actuating position from first offset value memory 115, and outputs the sum at its output. The output of setting unit 60 is then supplied to actuating drive 22 which, starting from emergency air position NLP, that is, from lower mechanical stop 30, moves throttle valve 18 by the summed angles formed at the output of setting unit 60, and thus sets the desired positive throttle valve angle αDK.

Besides slider potentiometer 26, pressure sensor 50 and actuating drive 22, setting position specification unit 150 according to FIG. 2 is also situated outside device 55, but setting position specification unit 150 may also be situated inside device 55.

In the following, it is described how the specified minimum value stored in minimum value memory 90 and the specified maximum value stored in maximum value memory 95 are able to be ascertained. To ascertain the specified minimum value for the corrected offset value for the air mass flow, a first boundary characteristics curve is ascertained, for instance, on a test stand, whose offset value of the actuating position is greater than the offset value of nominal characteristics curve 40 by a specified maximum value. Furthermore, this first boundary characteristics curve has an offset value for the air mass flow which is less than offset value m offsetn for the air mass flow of nominal characteristics curve 40. An example of such a boundary characteristics curve is second actual characteristics curve 45 according to FIG. 6. For a specified throttle valve angle αDK that is as large as possible, one then ascertains the absolute value of the difference between the air mass flow values of nominal characteristics curve 40 and first boundary characteristics curve 45 for this specified throttle valve angle. The specified throttle valve angle may be selected to be as large as possible, in this instance, because the difference between nominal characteristics curve 40 and first boundary characteristics curve 45 becomes greater with increasing throttle valve angle, but not too great, because with increasing throttle valve angle αDK, the measurement of pressure p over pressure sensor 50, and thus the determination of the actual air mass flow m ist of first boundary characteristics curve 45 becomes more inaccurate. Thus, when selecting specified throttle valve angle αDK, a compromise has to be made, on the one hand, between an actual value m ist for the air mass flow of first boundary characteristics curve 45, that is as accurate as possible, and on the other hand, a difference that is as great as possible between nominal characteristics curve 40 and first boundary characteristics curve 45. Subsequently, the absolute value ascertained for specified throttle valve angle αDK of the difference between the two characteristics curves 40, 45 is subtracted from offset value m offsetn for the air mass flow of nominal characteristics curve 40. The result formed in this subtraction then represents the specified minimum value for the offset value for the air mass flow, which is stored in minimum value memory 90. In the example according to FIG. 6, for instance, for throttle valve angle αDK2 one may select the difference as third difference value Δm 3 between the two characteristics curves 40, 45, for determining the specified minimum value.

In a corresponding manner, the specified maximum value for maximum value memory 95 can be determined with the aid of a second boundary characteristics curve 175, whose offset value of the actuating position is reduced by a specified maximum value compared to the offset value of the actuating position of nominal characteristics curve 40, for instance, in absolute value by the same specified maximum value as that by which the offset value of the actuating position of first boundary characteristics curve 45 is increased compared to the offset value of the actuating position of nominal characteristics curve 40. The offset value for the air mass flow of second boundary characteristics curve 175, in this instance, is greater than offset value m offsetn for the air mass flow of nominal characteristics curve 40. Second boundary characteristics curve 175, in this instance, is also, for instance, ascertained on a test stand, in a corresponding way to first boundary characteristics curve 45. In the same way as described before, a specified throttle valve angle is selected, for example, the same as in the case of first boundary characteristics curve 45, in which, on the one hand, actual value m ist for the air mass flow of second boundary characteristics curve 175, ascertained via pressure sensor 50, is as accurate as possible, and on the other hand, the distance between second boundary characteristics curve 175 and nominal characteristics curve 40 is as large as possible in absolute value. The absolute value of this distance is then added to offset value m offsetn for the air mass flow, in order to form the maximum value which is then stored in maximum value memory 95.

Consequently, for the desired measuring accuracy of pressure sensor 50, at correspondingly specified throttle valve angle, there comes about a maximum difference in absolute value between nominal characteristics curve 40 and first boundary characteristics curve 45 or second boundary characteristics curve 175. This difference between nominal characteristics curve 40 and first boundary characteristics curve 45 or second boundary characteristics curve 175 may also be used for smaller throttle valve angles a to ascertain the specified minimum value or the specified maximum value, in this case the tolerance range for the offset value for the air mass flow, within which the offset value for the air mass flow of the actuating position is not corrected, becoming smaller.

The specified maximum increase in offset value αDKoffsetn of the actuating position of nominal characteristics curve 40 for the formation of first boundary characteristics curve 45 or the maximum reduction in this offset value for the formation of second boundary characteristics curve 175 leads, correspondingly, to a shifting of nominal characteristics curve 40 and a first tolerance angle that is a maximum in absolute quantity in the direction towards first boundary characteristics curve 45 or by a second tolerance angle that is a maximum in absolute quantity in the direction towards second boundary characteristics curve 175, the two maximum tolerance angles being able to be equal in absolute quantity or even different, depending on whether offset value αDKoffsetn of the actuating position of nominal characteristics curve 40 is decreased by the same amount for the formation of second boundary characteristics curve 45, or not.

The output of second subtraction element 85 represents an adjustment value for the offset value for the air mass flow. As long as this adjustment value for the offset value for the air mass flow is between the specified minimum value and the specified maximum value, a correction of the offset value of the actuating position in first offset value memory 115 does not take place. Instead, the adjustment value for the offset value for the air mass flow is entered into file in second offset value memory 165. Only when the adjusted offset value for the air mass flow is at the output of second subtraction element 85, outside the region enclosed by the specified minimum value and by the specified maximum value, is this adjusted offset value for the air mass flow no longer entered into file in second offset value memory 165, and instead, the adjustment described of the offset value of the actuating position is carried out by updating first offset value memory 115, using the output of addition element 110.

The described adjustment of the offset value of the actuating position or the offset value for the air mass flow using device 55 may be carried out for any desired throttle valve angle αDK, and this may be done even during running operation of the internal combustion engine.

Figure 3:
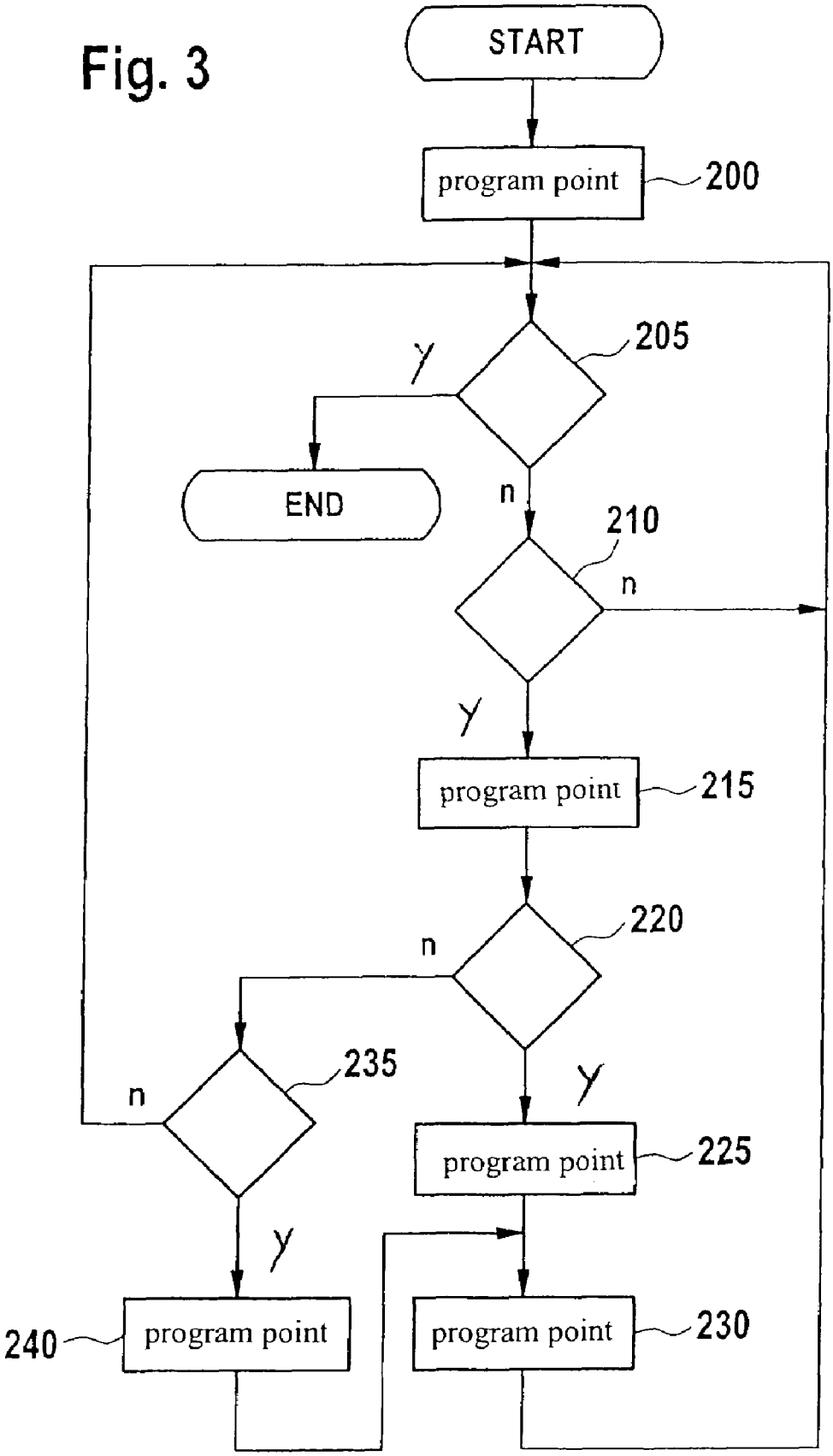
FIG. 3 is a flow chart to explain the method.

FIG. 3 shows a flow chart which once more clarifies the sequence of the method. After the start of the program, for instance, by operating the ignition switch, at a program point 200, driving cycle memory 135 is overwritten by a set bit, so that the output of driving cycle memory 135 is set. The system subsequently branches to a program point 205.

At program point 205, device 55 checks whether an adjustment of the offset value of the actuating position has taken place in the current driving cycle, or whether the current driving cycle was terminated, for instance, by shutting down the internal combustion engine. If this is the case, the program is exited; otherwise the program branches back to program point 210. The checking described at program point 205 can be done by checking whether the output of driving cycle memory 135 has been reset. If this is the case, the program is exited; otherwise, that is, if the output of driving cycle memory 135 is set, branching takes place to program point 210.

At program point 210 it is checked whether the output of low-idle switch time element 130 has been set, that is, whether the low-idle state has been set at least for the specified time. If this is the case, then the system branches to a program point 215; otherwise the system branches back to program point 205.

At program point 215, in device 55 the adjusted offset value for the air mass flow is ascertained at the output of second subtraction element 85. The system subsequently branches to a program point 220.

At program point 220, it is checked with the aid of first comparison element 100 whether the adjusted offset value for the air mass flow is less than the specified minimum value. If so, the program branches to a program point 225; otherwise the program branches to a program point 235.

At program point 225, the offset value of the actuating position read out from first offset value memory 115 is incremented by the first specified incrementing value in first correcting unit 65. The system subsequently branches to a program point 230.

At program point 230, driving cycle memory 135 and with that its output are reset. The program subsequently branches back to program point 205.

At program point 235 it is checked in device 55, using second comparison element 105, whether the adjusted offset value for the air mass flow is greater than the specified maximum value. If this is the case, then the system branches to a program point 240; otherwise the system branches back to program point 205.

At program point 240, the offset value of the actuating position read out from first offset value memory 115 is decremented by the second specified incrementing value using second correcting unit 70. The program subsequently branches to program point 230.

The program as in FIG. 3 is executed, for example, in the scan clock pulse for each renewed scanning of throttle valve angle αDK by slider potentiometer 26 and the ascertainment, assigned to this throttle valve angle, of intake pipe pressure p by pressure sensor 50, so that, in response to each calling up of program point 215 from the just current variables αDK, p ascertained by sensors 26, 50, as in the manner described, the currently adjusted offset value for the air mass flow is formed at the output of second subtraction element 85.

In the exemplary embodiment described above, it is assumed that the actuating position, starting from the emergency air position as specified actuating position, is moved by the offset value of the actuating position, in order to achieve an actuating position having specified an air mass flow as dip-through position. However, any actuating position that may be set may be specified as output position. Appropriately, any air mass flow that may be set may be specified. The offset value of the actuating position is then selected, analogously to the exemplary embodiment described, such that the actuating position has to be moved, starting from the specified actuating position, by the offset value of the actuating position, in order to achieve an actuating position in which the specified air mass flow is achieved. In the case of several possible actuating positions for the specified air mass flow, it has to be specified what number of actuating positions having the specified air mass flow are to be skipped, starting from the specified actuating position, by moving actuator 18 by the offset value of the actuating position.

If the specified actuating position is not an end position or a stop of actuator 18, the direction of the motion of the actuator for achieving the specified air mass flow may also be specified. This is significant if the specified air mass flow is able to be achieved in a plurality of directions of motion, starting from the specified actuating position.

What is claimed is:

1. A method for operating an internal combustion engine, comprising:

influencing an air mass flow supplied to the internal combustion engine by an actuator in an air supply;

starting from a specified actuating position, moving the actuator by an offset value of the actuating position for setting of an actuating position of the actuator having a specified air mass flow; and correcting the offset value of the actuating position as a function of an offset value for the air mass flow;

wherein the offset value of the actuating position is corrected in the correcting step as a function of whether the offset value for the air mass flow falls below a specified minimum value or exceeds a specified maximum value.

2. The method according to claim 1, further comprising decreasing the offset value of the actuating position if the offset value for the air mass flow exceeds the specified maximum value.

3. A method for operating an internal combustion engine, comprising:

influencing an air mass flow supplied to the internal combustion engine by an actuator in an air supply;

starting from a specified actuating position, moving the actuator by an offset value of the actuating position for setting of an actuating position of the actuator having a specified air mass flow; and correcting the offset value of the actuating position as a function of an offset value for the air mass flow;

wherein the offset value of the actuating position is corrected in the correcting step as a function of whether the offset value for the air mass flow falls below a specified minimum value or exceeds a specified maximum value, and wherein further comprising ascertaining the specified minimum value or the specified maximum value as a function of a difference between a nominal characteristics curve of the actuator and a boundary characteristics curve of the actuator.

4. The method according to claim 3, wherein the difference corresponds to a maximum in absolute quantity.

5. The method according to claim 3, further comprising selecting a characteristics curve of the actuator as the boundary characteristics curve shifted by a maximum tolerance angle with respect to the nominal characteristics curve.

6. A method for operating an internal combustion engine, comprising:

influencing an air mass flaw supplied to the internal combustion engine by an actuator in an air supply;

starting from a specified actuating position, moving the actuator by an offset value of the actuating position for setting of an actuating position of the actuator having a specified air mass flow;

correcting the offset value of the actuating position as a function of an offset value for the air mass flow; and increasing the offset value of the actuating position if the offset value for the air mass flow falls below a specified minimum value.

7. A method for operating an internal combustion engine, comprising:

influencing an air mass flow supplied to the internal combustion engine by an actuator in an air supply;

starting from a specified actuating position, moving the actuator by an offset value of the actuating position for setting of an actuating position of the actuator having a specified air mass flow;

correcting the offset value of the actuating position as a function of an offset value for the air mass flow; and adjusting the offset value for the air mass flow as a function of a deviation of a first value for the air mass flow, recorded by a first sensor, from a second value for the air mass flow, recorded by second sensor, at a same actuating position of the actuator.

8. The method according to claim 7, wherein the first sensor is arranged as one of(a) a main load sensor and (b) a main charge sensor and the second sensor is arranged as one of (a) a secondary load sensor and (b) a secondary charge sensor.

9. The method according to claim 7, wherein the first sensor is arranged as a pressure sensor in the air supply.

10. The method according to claim 7, wherein the second sensor is arranged as a sensor adapted to record the actuating position of the actuator.

* * * * *